US005779601A

United States Patent [19]

Ish, III

[11] Patent Number: 5,779,601

[45] Date of Patent: Jul. 14, 1998

[54] COMPACT MULTI-STATION EXERCISE MACHINE

[75] Inventor: A. Buell Ish, III, Renton, Wash.

[73] Assignee: Vectra Fitness, Incorporated, Redmond, Wash.

[21] Appl. No.: 597,522

[22] Filed: Feb. 2, 1996

[51] Int. Cl.[6] ..... A63B 21/00

[52] U.S. Cl. ..... 482/100; 482/102; 482/138

[58] Field of Search ..... 482/94, 97–103, 482/112, 113, 130, 133–138, 142, 148, 908; D21/195

[56] References Cited

U.S. PATENT DOCUMENTS

| | | | |
|---|---|---|---|
| Re. 34,577 | 4/1994 | Habing et al. | 482/138 |
| 4,711,448 | 12/1987 | Minkow et al. | 482/142 |
| 4,986,538 | 1/1991 | Ish, III | 482/138 |
| 5,042,801 | 8/1991 | Sterba et al. | 482/137 X |
| 5,263,915 | 11/1993 | Habing | 482/138 X |
| 5,336,148 | 8/1994 | Ish, III | 482/137 X |
| 5,362,290 | 11/1994 | Huang | 482/138 X |
| 5,518,477 | 5/1996 | Simonson | 482/138 X |

*Primary Examiner*—Richard J. Apley
*Assistant Examiner*—John Mulcahy
*Attorney, Agent, or Firm*—Seed and Berry LLP

[57] ABSTRACT

A multi-station exercise machine in which each of the exercise stations is interconnected with a weight stack using a reeving system having corner frame with right and left wings at right angles to one another. High and low pull cables in the reeving system extend from the corner frame. The wings have butterfly and press stations at their outer end. The press station connects to the reeving system via a horizontal extension member which turns responsive to swinging of a press arm. An adjustment linkage permits the starting position of the press arm to be varied by operation of a lever at the press station. An adjustable bench with a leg exercising mechanism is optionally used at the press station as only a bench, or is used in a diagonal position at which the leg exercising mechanism is connected to the low pull cable.

16 Claims, 8 Drawing Sheets

COMPACT MULTI-STATION EXERCISE MACHINE

TECHNICAL FIELD

The present invention relates to exercise machines of the type having multiple exercise stations on a single support frame assembly.

BACKGROUND OF THE INVENTION

Multi-station exercise machines having press, butterfly and leg curl/extension exercise stations operating from a single weight stack have become popular for home use, but have required more floor space than may be available or desirable because typically these stations have been arranged to occupy different quadrants. This necessitates a floor area about 8 ft. by 11 ft. for the machine and the additional body space required to perform the exercises. Thus, a need has arisen for a more compact multi-exercise machine requiring substantially less floor area.

SUMMARY OF THE INVENTION

The present invention answers the need for a more compact exercise machine by providing a machine which will fit conveniently against adjoining walls at the corner of a room and require only a floor space of about 5 ft. by 6 ft. This is accomplished by providing a frame with a corner column and two wing extensions at right angles to one another. One of these extensions supports a butterfly station at which the exerciser faces with his (her) back to the wall which is behind the butterfly station, and the other one of the extensions has a press station in which the press arms swing toward and away from the adjoining wall which is directly behind the press station. The leg curl/extension station is provided at the outer end of an adjustable bench and is used when the bench is positioned to extend from the corner column diagonally outwardly between the press and butterfly stations. The bench is shifted to extend from the press station at right angles to the adjacent wall when using the press station.

The improved exercise machine incorporates a reeving system in which selected weights from a single weight stack is used as a load for each of the exercise stations without disconnecting any cables except for an extension cable for the leg curl/extension station on the bench. This extension cable connects to the cable for a low pull station at the base of the corner column. A high pull station is also provided at the corner column.

To enable operation of the press station in the described position, the press arms are mounted on an extension tube which extends horizontally from the corner column. The arrangement is such that when the tube is turned about its longitudinal axis responsive to swinging the press arms downwardly, the movement is resisted by the selected weight load applied via the reeving system. The starting position for the press arms is adjustable by operation of an adjustment handle at the press station which functions to disengage the extension tube and related latching mechanism tube from the reeving system while it is turned by the press arms to the selected starting position.

DETAILED DESCRIPTION OF THE INVENTION

Figure 1:
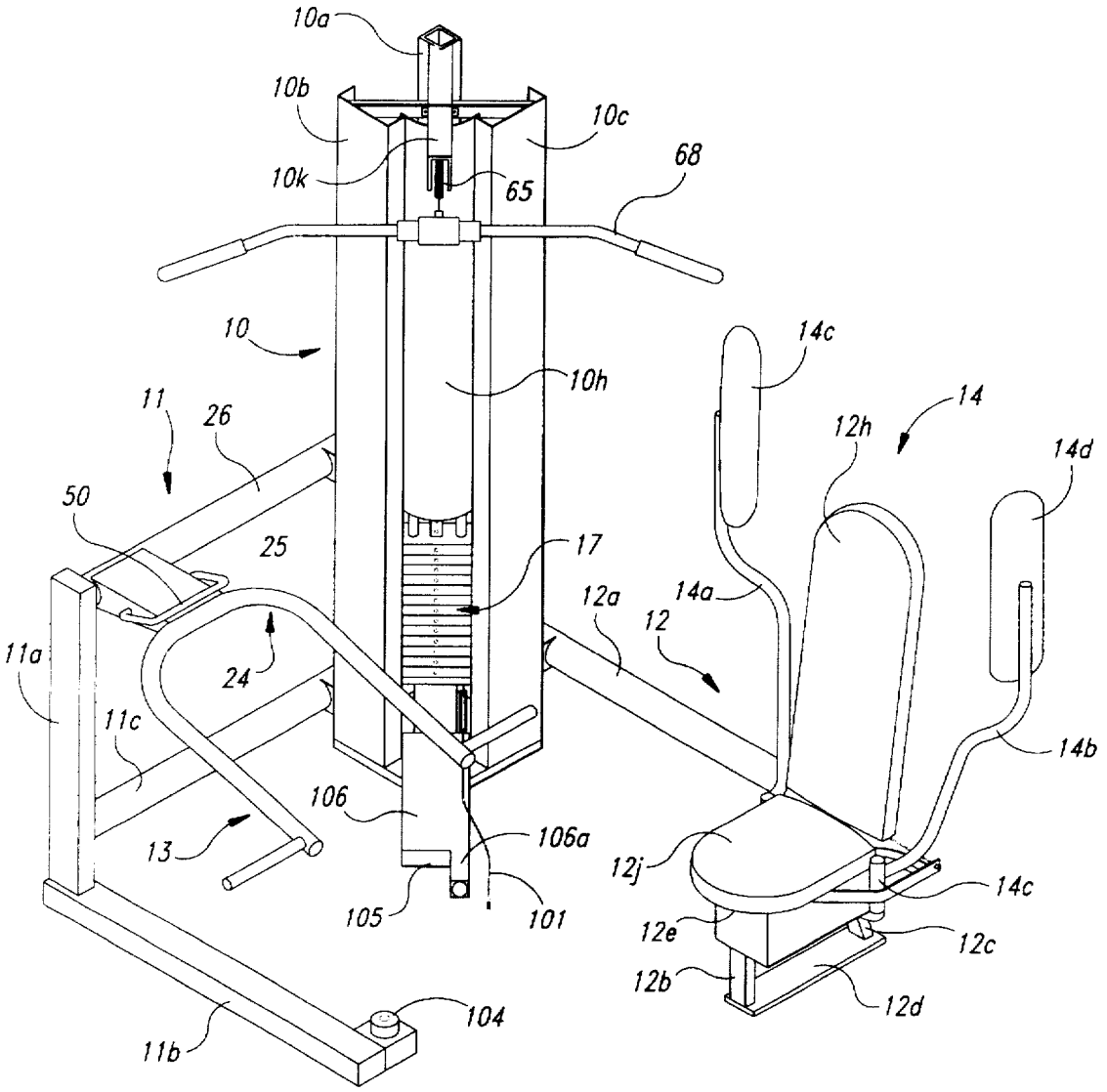
FIG. 1 is a perspective view of an exercise machine embodying the present invention without the bench being shows.
Figure 2:
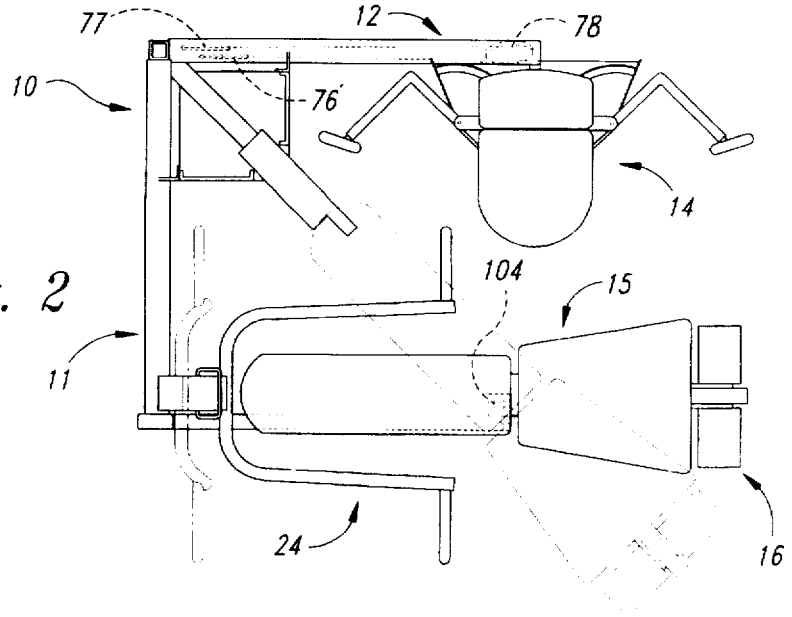
FIG. 2 is an abbreviated top plan view of the exercise machine showing the alternative bench positions.

The exercise machine of the present invention incorporates a corner frame 10 from which extend right and left frame extensions 11–12 as wings. In this description "right" and "left" designate directions as viewed by a person with his (her) back facing the corner frame 10. The right frame extension supports a press station 13 and the left frame extension supports a butterfly station 14. The exercise machine also includes a multi-position bench 15 having a leg developer 16 at its forward end. As will be later explained in detail, this bench 15 is moved between a position opposite the butterfly station and a generally diagonal position between the press and butterfly stations as indicated in FIG. 2.

Figure 3A:
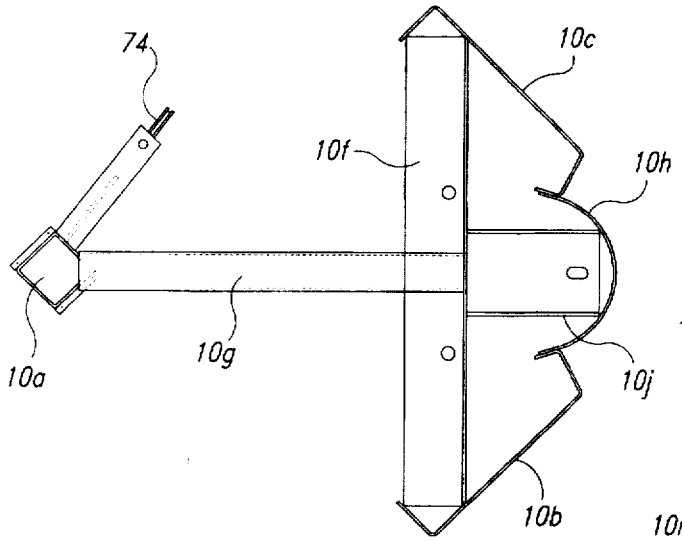
FIG. 3A is a top plan view of the corner frame taken as indicted by line 3A—3A in FIG. 4.
Figure 3B:
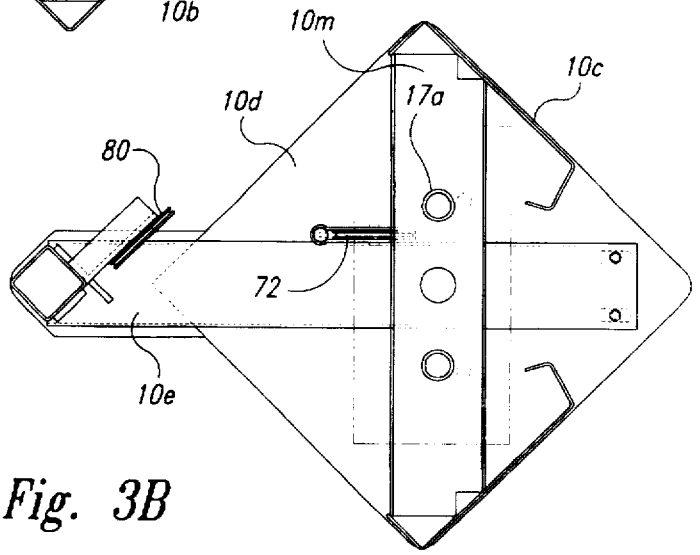
FIG. 3B is a horizontal sectional view of the corner frame taken as indicated by line 3B—3B in FIG. R.
Figure 4:
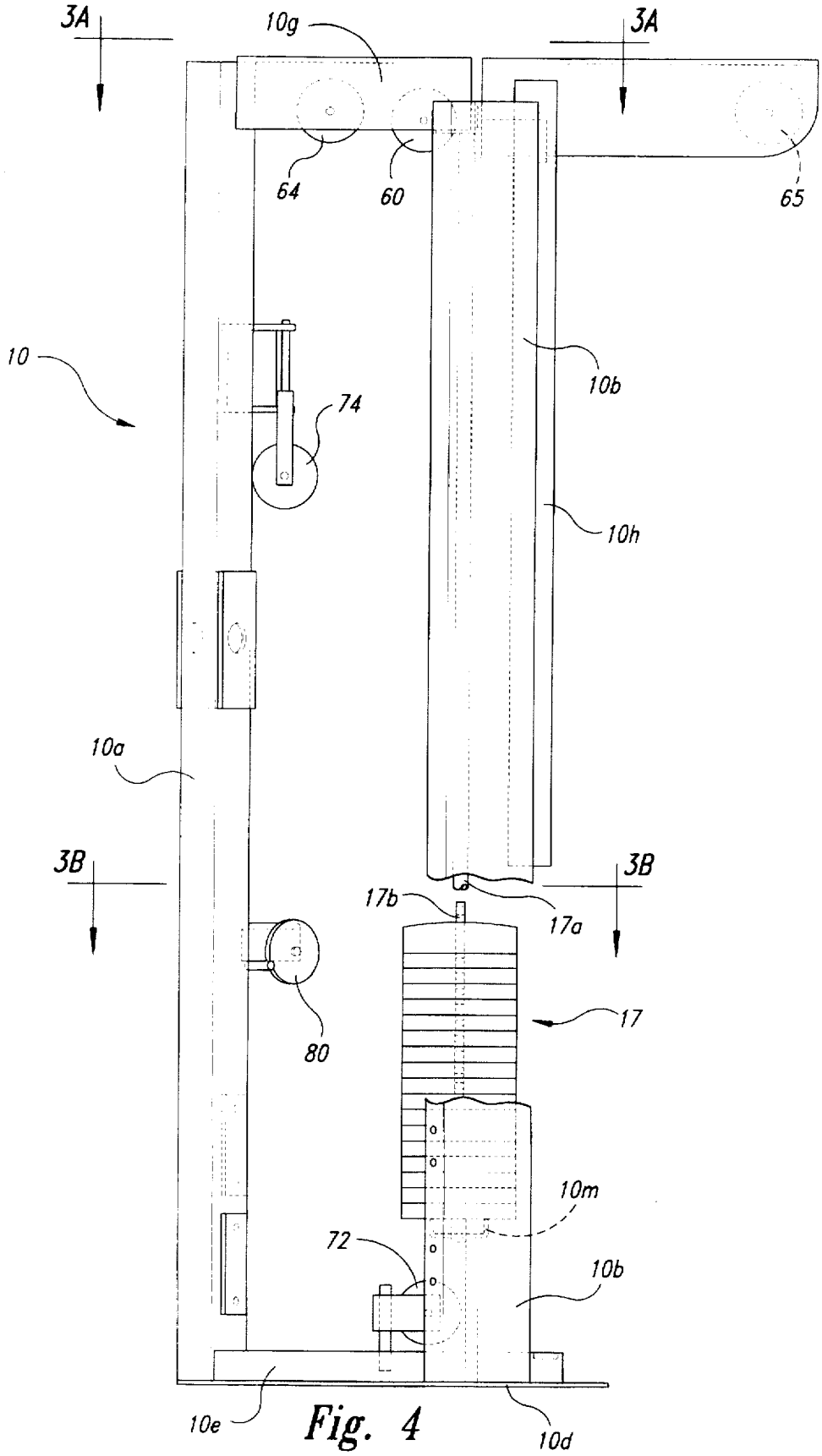
FIG. 4 is an elevational view of the corner frame as seen from the right side.

The corner frame 10 has a tubular corner member **10*a* and right and left channels 10*b*–10*c* extending upwardly as columns from a base assembly (FIG. 3B) comprising a square bottom plate 10*d* surmounted by a diagonally extending base channel 10*e* projecting rearwardly beneath the corner tube 10*a*. As shown in FIG. 3A, an upper angle bar 10*f* interconnects the corner tube 10*a* and channels 10*b*–10*c* and supports the forward end of a downwardly opening channel 10*g* having its other end fixed to the upper end portion of the corner tube 10*a*. At the front of the channel members 10*b*–10*c* there is mounted a front cover 10*h* extending from a position spaced from slightly above the top level of the channel members 10*b*–10*c* to a level part way down from the top thereof. The front cover 10*h* has a central rectangular cutout at the top, and an upwardly opening channel section 10*j* extends rearwardly from a weld connection at the border of this cutout to a connection to the angle bar 10*f*. An outreach channel 10*k* projects diagonally from a rearward portion which seats on the channel section 10***j* and is bolt connected to the channel section and the angle bar 10*f*.

A standard weight stack unit 17 is supported on a cross-member 10*m* on the frame 10 which extends between the column channels 10*b*–10*c* and is welded thereto at a position raised above the base channel 10*e*. The weight stack unit 17 has a pair of upright guide bars 17*a* extending between the upper angle bar 10*f* and the base channel 10*e*, and has a selector rod 17*b* passing downwardly through the stack of weight plates in the weight stack. This selector rod has a row of holes therealong registering with lateral holes in the weight plates so that a weight selector pin can be inserted through a selected weight plate and thereby couple that weight plate and those thereabove to the selector rod 17*b*.

The right frame extension 11 for the press station has an upright tubular member 11*a* which is mounted on a ground engaging outrigger member 11*b* and is connected to the corner member 10*a* and right channel member 10*b* by a bolt-connected brace member 11*c*. The left frame extension 12 includes a left tubular brace member 12*a* which is bolt-connected to the upright members 10*a*, 10*c* and extends at the left side of the machine to the butterfly station 14 where it attaches to the back of a seat support frame having front and back legs 12*b*, 12*c* connected together by a flat floor engaging rung 12*d* and a seat support plate 12*e* which angles downwardly at the front as a skirt and doubles back. The back leg 12*c* projects upwardly above the level of the seat support plate 12*e* to a cross-member which extends horizontally between a pair of back support members 12*g* connected at their lower ends to the seat support plate 12*e*. A padded back rest 12*h* and seat 12*j* are mounted on the members 12*g* and the seat support plate 12*e*, respectively.

The butterfly station 14 provides a pair of tubular swing arms 14*a*–14*b* which carry padded wings 14*c*–14*d* and have respective bottom tubular extensions 14*e* journaled on vertical stub shafts. These stub shafts extend between the ends of a upper and lower members 12*k*–12*l* on the seat structure. Cam units 18—18' on the tubular extensions 14*e* swing at different levels from a stop position engaging the back of the seat skirt. Cable connection keyhole slots are provided in ears at outer ends of the cam units. It is preferred that the butterfly unit have adjustment for the rear position of the butterfly arms as provided in U.S. Pat. No. 5,378,216.

Figure 6A:
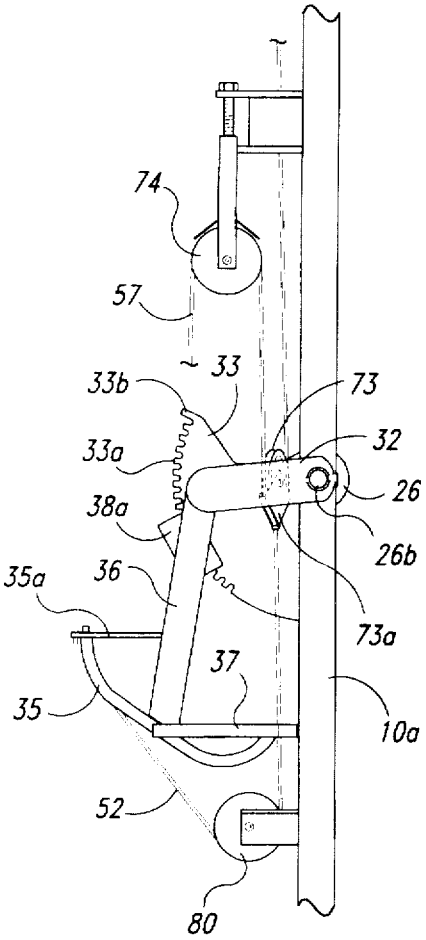
FIG. 6A is a fragmentary elevational view as seen from the left side of the corner frame and showing the related parts when the press arm is at a lowered start position.

The press station 13 includes a press arm unit 24 presenting a pair of press arms 24*a* having handles 24*b* at their outer ends. The press arm unit is fixed to a bracket 25 extending laterally from a rigid connection to a horizontal extension tube 26. This tube 26 has a right stub shaft 26*a* journaled in the right upright member 11*a* and a left stub shaft 26*b* journaled in the corner column 10*a* and projecting therebeyond. A swing assembly 30 is provided including a swing arm 32 and a curved adjustment plate 33 which are journaled on the left stub shaft 26*b* at opposite sides of the corner column 10*a* and are cross-connected by a cross-member 34 which is spaced from the corner column 10*a*. A lever arm 36 projects from the center of the cross-member 34, and the adjustment plate 33, has an elongated hub 33*d* journaled on the stub shaft 26*b*. A cam strip 35 shaped to receive a cable is mounted on the free end of the lever arm 36, and a stop rod 37 is fixed to the free end of the lever arm 36 and positioned to the left of the cam strip 35. The stop rod 37 extends rearwardly from the lever arm 36 toward the corner column 10*a* and preferably has a bumper on its rear end for engagement with the corner column 10*a* as a stop as seen in FIG. 6A.

The adjustment plate 33 has an arcuate forward edge containing a series of teeth 33*a* and having stop ears 33*b*, 33*c* at its opposite ends. Complementing the adjustment plate is a swing plate 38 extending along side the adjustment plate laterally from a weld connection to the left end of the extension tube 26. At its outer end the swing plate 38 is formed with a retaining hook 38*a* doubling back around the toothed edge portion of the adjustment plate. This hooked portion 38*a* has a pair of aligned radially-extending slots 39 receiving a latching finger 40 extending through the slots integrally from the outer end of a link 41 of round bar stock having its inner end bent to provide an integral pin 42 passing through a hole in a crank 43. This crank projects through a side opening in the extension tube 26 from a rocker shaft 44 extending along the inside of the extension tube 26. This rocker shaft has its ends passing through openings in a pair of inserts 46 which are welded to the inner ends of the stub shafts 26*a*, 26*b* and to the extension tube 26. Adjacent its right end the rocker shaft 44 has a second crank 46 extending through a respective side opening in the extension tube to pivotally connect via an intermediate link 48 with a generally U-shaped handle 50. The handle is swing-mounted for up and down swinging movement by right and left trunnion portions 50*a*–50*b* passing through holes in laterally spaced side walls of the bracket 25. The handle continues rearwardly beyond the trunnion 50*b* as a lever 51. This lever and the crank 56 have holes therethrough receiving bent end portions 48*a*, 48*b* on the link 48. A tension spring 49 is anchored at one end on an ear mounted on the bracket 25 and has its other end hooked over the link 48 adjacent the outer end portion 48*a* of the link so as to bias the handle 50 downwardly toward the bracket 25.

With the described mechanism interconnecting the adjustment handle 50 and the latching finger 40, it is seen that manually swinging the handle upwardly causes the lever 51 to swing downwardly in opposition to the spring 49 and thereby pull on the link 48 such that the crank 46 responsively is swung downwardly. The resulting turning of the rocker shaft 44 in the clockwise direction when viewed from the right end, swings the crank 43 at the left end of the rocker shaft downwardly, and this motion pushes on the link 41 such that the latching finger 40 is moved outwardly to the outer end of the slots 39. In this outer position the latching finger 40 is radially outward of the teeth in the adjustment plate 33. The press arm unit 24 is then free to be swung to the desired starting position resulting in swinging of the swing plate 38 and latching finger 40 relative to the adjustment plate 33. The adjustment handle 50 is then released causing the latching finger 40 to retract in the slots 39 and mesh between the adjacent teeth 33*a* on the adjustment plate 33, thereby coupling the swing plate 38 and adjustment plate 33 together. The press arm unit 24 can be lowered to a substantially vertical out of the way position as indicated by the broken line position in FIG. 2, in which the latching finger engages the stop ear 33*c* on the adjustment plate 33. The other stop ear 33*b* limits upward movement of the press arm unit during adjustment of its starting position.

Figure 6B:
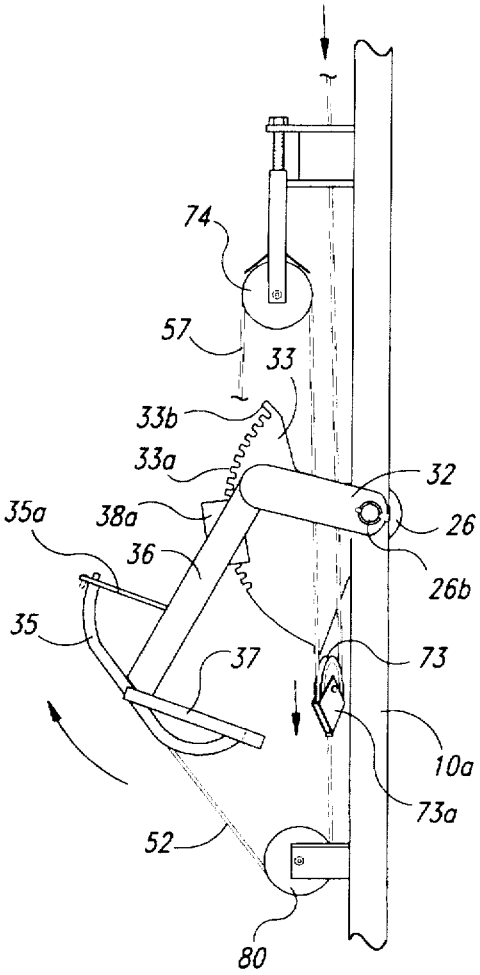
FIG. 6B corresponds to FIG. 6A and shows the positions of the related parts when the press arm has been raised from the start position.
Figure 7A:
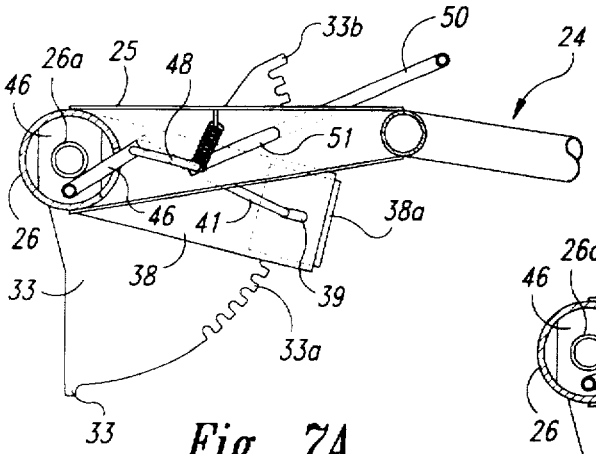
FIGS. 7A and 7B are fragmentary vertical sectional views taken as indicated by line 7A, 7B–7A, 7B in FIG. 8 and showing the positions of the adjustment mechanism for the press arm corresponding to FIGS. 6A and 6B.
Figure 7B:
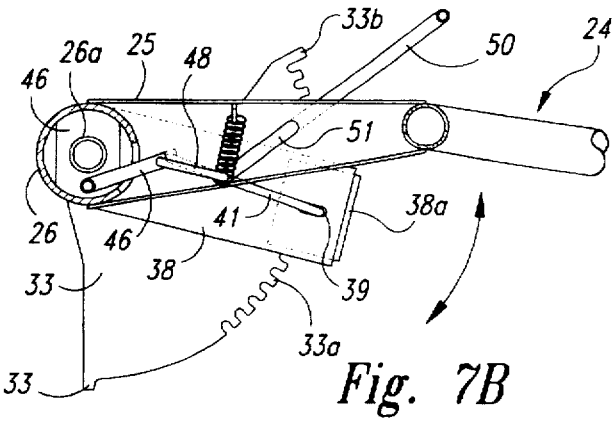
Figure 8:
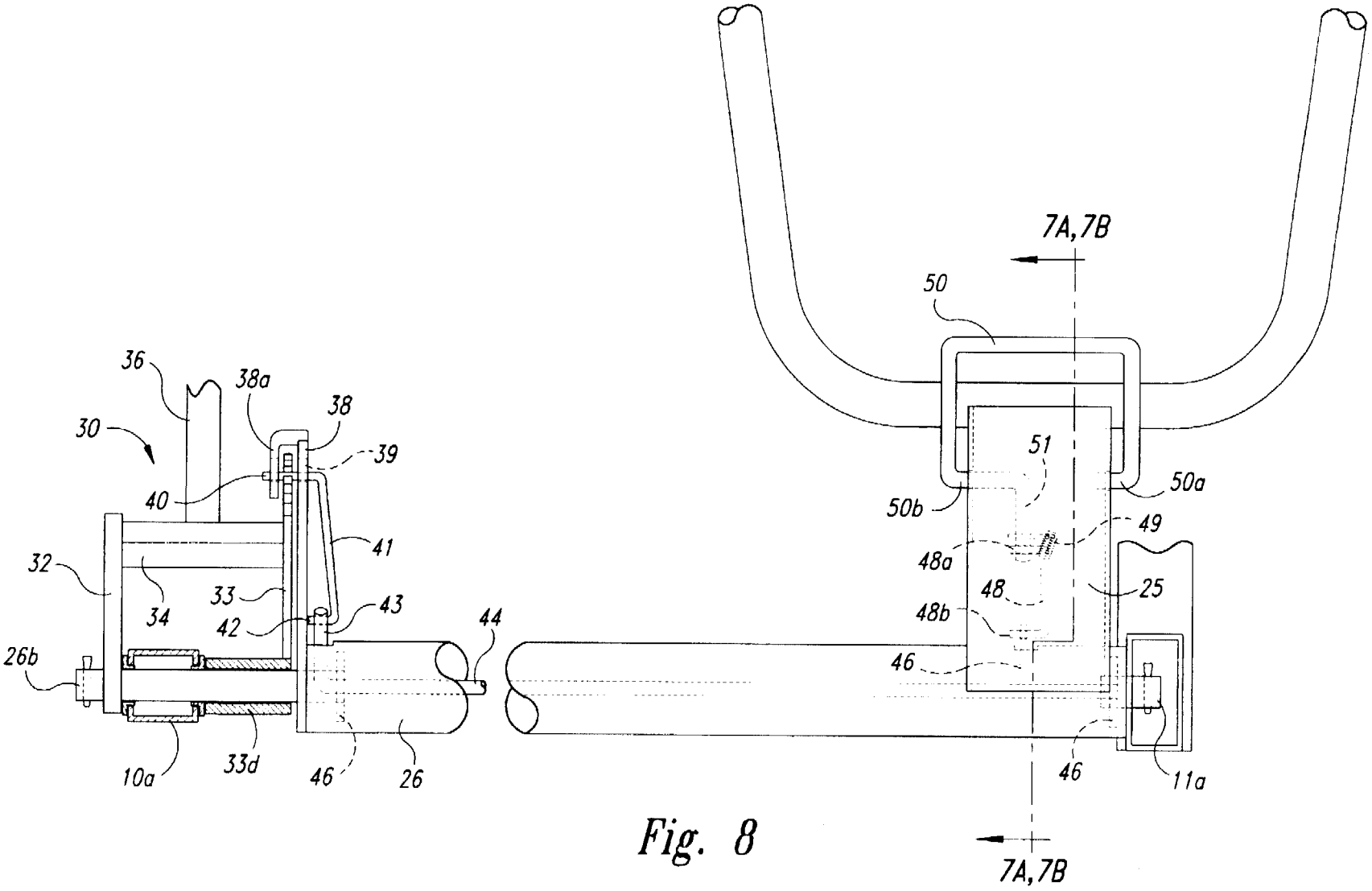
FIG. 8 is a horizontal fragmentary sectional view taken at a level above the extension tube and related mechanism.
Figure 9:
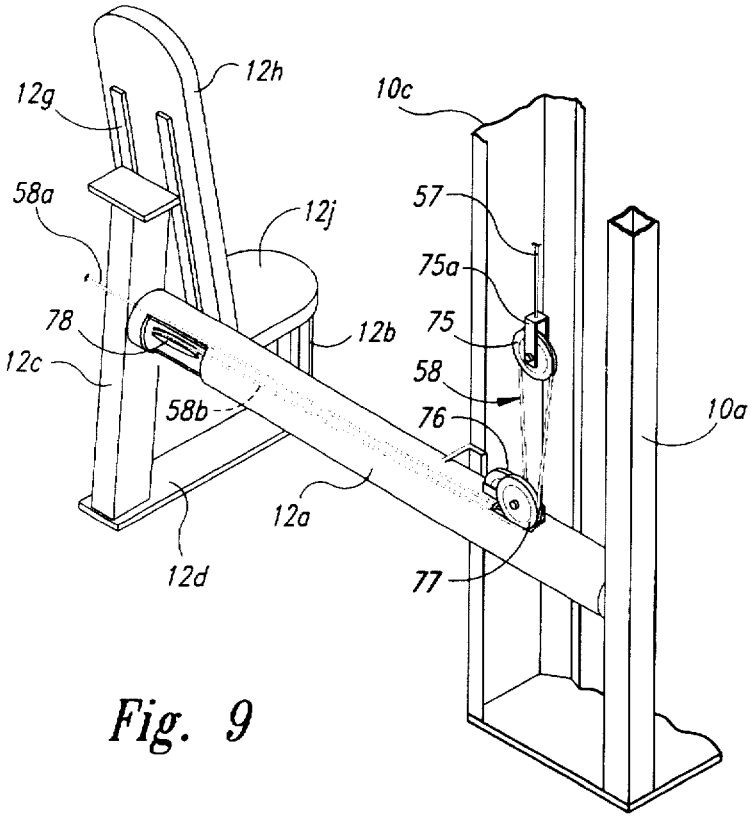
FIG. 9 is a fragmentary perspective view looking forwardly from behind the back of the left side of the exercise machine.
Figure 10:
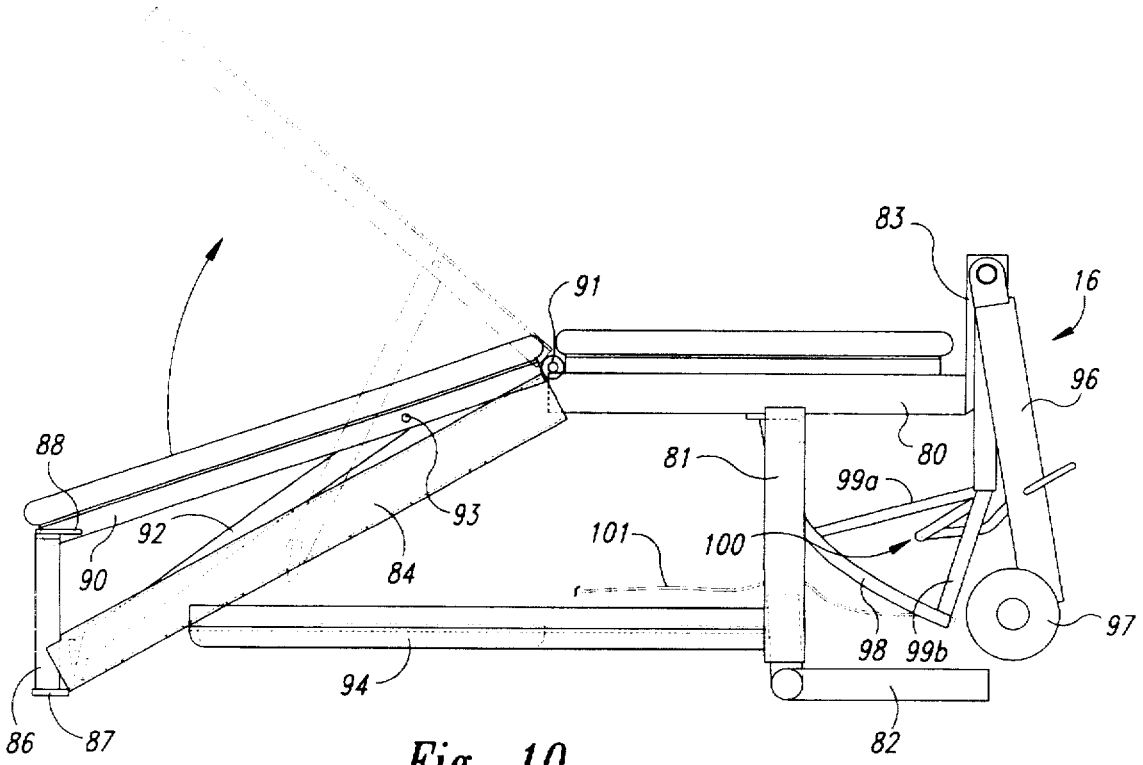
FIG. 10 is a side elevational view of the bench.
Figure 11:
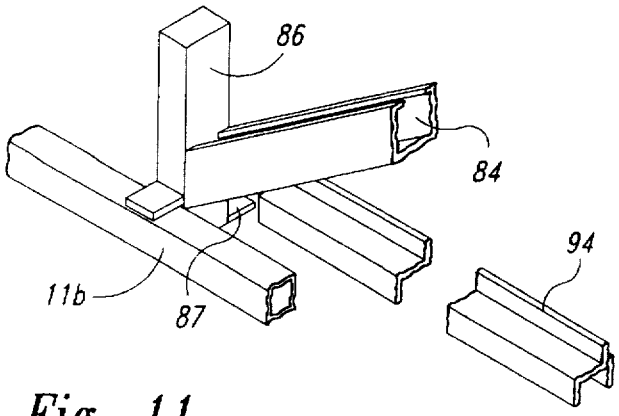
FIG. 11 is a detail perspective view of the rear of the bench frame.

From the foregoing it is seen that upward swinging of the press arm unit 24 from the selected starting position in performing a press exercise results in forward and upward swinging of the cam strip 35 by connection of the press arm unit therewith via the extension tube 26, swing plate 38, latching finger 40, adjustment plate 33, and lever arm 32. As shown in FIG. 6B, such movement of the cam strip 35*a*, results in tensioning of a press cable 52 positioned in a keyhole slot at the outer end of a brace 35*a* for the cam strip and having a ball stop 53 engaging the brace. This press cable 52 is part of a reeving system connected to the top of the selector rod 17*b* passing downwardly through the stack of weight plates in the weight stack unit 17. Hence, upward swinging of the press arm unit 24 is resisted by the selected load of weight plates in the weight stack.

Figure 5:
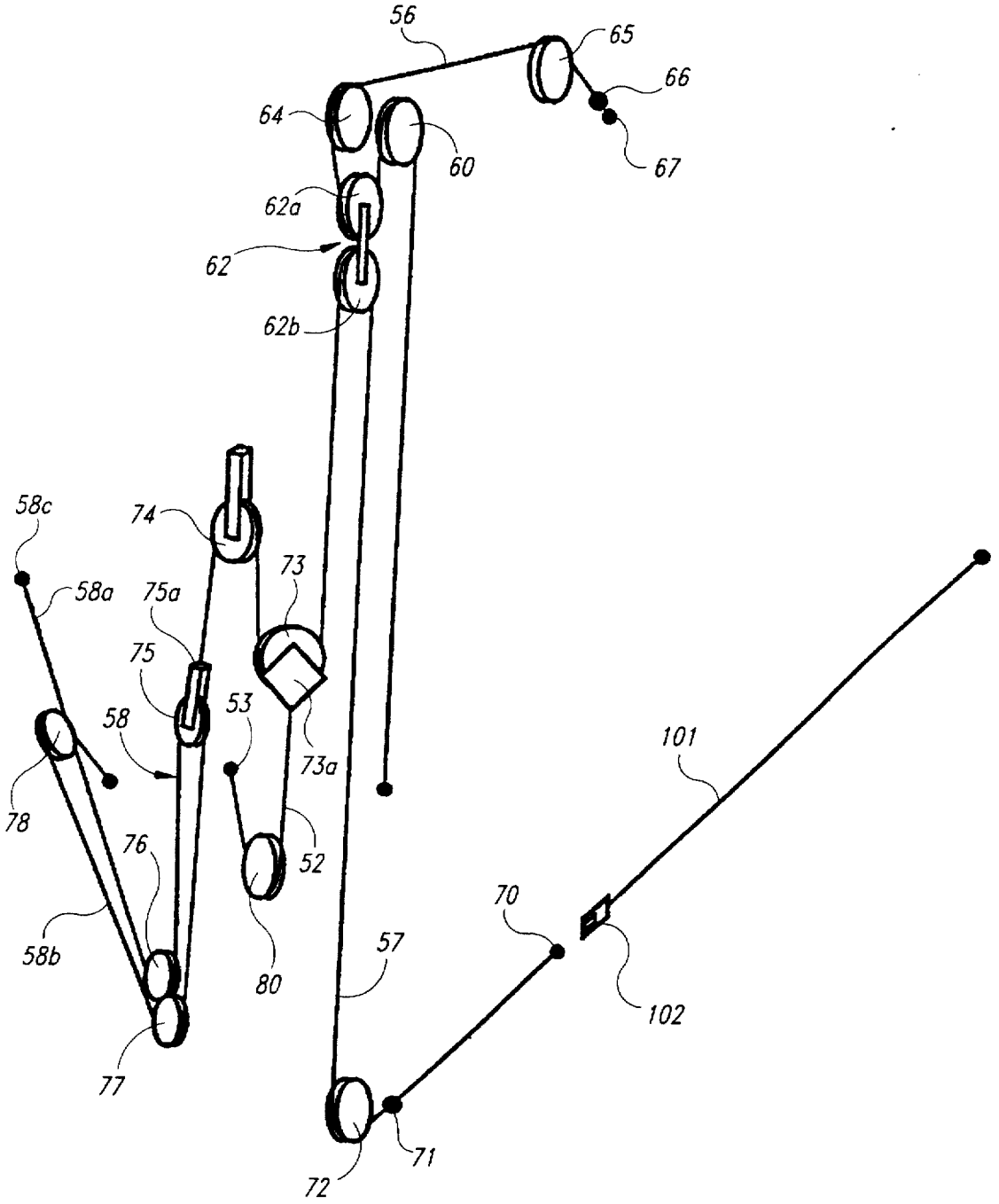
FIG. 5 is a schematic of the reeving system for the exercise machine.

The reeving system is shown schematically in FIG. 5 and includes a high pull cable 56, a low pull cable 57 and a butterfly cable 58. The high pulley cable 56 extends upwardly from the weight stack to a pulley 60 at the top of the frame, then loops downwardly under the upper pulley 62*a* of a double floating pulley assembly 62 and up to a single fixed pulley 64, and then over a high outreach pulley 65 in the outreach channel 10*k*. The cable 56 has a stop ball 66 adjacent its upper outer end limiting retraction of the cable and has a connector ball 67 at its upper end for interfitting with a pull bar 68. The low pulley cable 57 has a connector ball 70 at its lower outer end and a stop ball 71 adjacent the connector ball. The low pull cable 57 engages a low pulley 72 swivel mounted on the base beneath the weight stack, travels upwardly and over the lower pulley 62*b* of the double floating pulley 62, and loops downward around a single floating pulley 73. From the latter the cable 57 travels upwardly and over an adjustable pulley 74 and downwardly to connect with a hanger 75*a* carrying a floating pulley 75. This pulley 75 has the butterfly cable 58 looped thereover. The butterfly cable has one branch 58*a* passing through the tubular brace 11*a* via a first bottom guide pulley 76 in a cutout adjacent the corner column 10*a*, and then has a terminal ball 58*c* connecting to one of the cam units 18—18'. A second branch 58*b* of the butterfly cable 58 passes over guide pulleys 77–78 in cutouts adjacent opposite ends of the brace 11*a* and has a terminal ball 48*d* connected to the other cam unit. The press cable 52 is connected at an end to the frame 73*a* of the floating pulley 73, passes under a guide pulley 80 on the corner column 10*a*, and terminates at stop ball 53 connecting the press cable to the cam strip 35.

When the high pull cable 56 is tensioned by an exercise load applied to the connector 67 the high pull cable 56 responsively applies an upward force on the double floating pulley unit 62 and this is resisted by the ball 71 on the low pull cable 57, the ball 53 on the press cable 52 with the stop rod 37 engaging the corner column 10*a*, and the limitation on backward swing of the butterfly arms. As a result of limiting of the upward movement of the double floating pulley unit 62 the high pulley cable 56 can only move by pulling up the selected weight load. Similarly, when the low pull cable 57 is tensioned by an exercise load applied to the connector ball 70 such as by a pull bar (not shown) responsive movement can only occur at the double floating pulley unit 62, and namely downward movement of the double floating pulley unit 62 as permitted by upward movement of the selected weight load the same distance that the low pull cable 57 is advanced. When the press arm unit 24 is swung upwardly the floating pulley 73 and double floating pulley unit 62 move downwardly, thereby raising the selected weight loads. Lastly, when the butterfly arms are swung forwardly, the pulley 75 is pulled downwardly and this causes the double floating pulley unit 62 to be pulled downwardly thereby raising the selected weight by the cable 56. Adequate space is provided between the corner column 10*a* and the cross-member 34 to accommodate the floating pulley 73 and associated cables 57 and 52.

The bench 15 is used as a multi-position support when positioned at the press station 13, and as a leg exerciser when positioned in a generally diagonal position extending from the corner frame 10 between the press and butterfly stations 13–14. The bench frame includes a seat section 80, front leg section 81, foot section 82 at the bottom of the front leg section, a front upstanding post 83 on the seat section, and a rearwardly sloping leg section 84 extending from the back of the seat section, to a rear handle 86 in the form of an upwardly projecting post resting on a ground-engaging flat foot 87 projecting to the left. A stop arm 88 reaches out to the right from the handle 86. A back rest section 90 is swing-mounted at its forward end at a pivot 91 at the rear of the seat section 80 and has an adjustment strut 92 extending downwardly therefrom at a pivot 93 to assume selected positions interfitting with holes (not shown) along the bottom of the sloping rear leg section 84 for supporting the back rest section in a horizontal position and various sloped positions. The bench frame also has a horizontal rung 94 extending between the legs 81, 84 and presenting a downwardly facing channel track. Padded cushions are mounted on the seat and back frame sections 80, 90.

The leg developer 16 is swing mounted at the upper end of the front post 83 and includes a center swing leg 96 having padded leg engagement arms 97 adjacent its outer end.

A cam strip 98 is provided on support elements 99*a*, 99*b* which are interconnected by a linkage 100 to the swing leg 96 so that when the swing leg is swung upward the cam strip also swings upwardly to tension an extension cable 101. This cable 101 has a terminal portion fitting into a keyhole slot at the forward end of the cam strip 98 and held by a ball stop on the cable. The extension cable 101 is connected at its rear end to a connector 102 having a keyhole slot for receiving the ball 70 at the end of the low cable 57. The linkage 100 permits the swing leg 96 and related padded arms 97 to be alternatively positioned in raised or lowered exercise positions. The extension cable 101 is not used when the bench 15 is used in conjunction with the press station 13.

The outrigger 11*b* at the press station has at its outer end an offset to the left provided with a positioning post preferably in the form of a roller 104 for interfitting with the channel track at the bottom of the bench rung 94. The channel track is interrupted by an opening part way along its left side near the rear of the rung 94 so that if the bench is pulled outwardly somewhat from a normal use position it can be swung to the left at its forward end to easily free the bench from the roller 104 and move it all or part way from the normal exercise area.

When the bench is in its generally diagonal position for using the leg exercising mechanism at its outer end, the rear upright handle 86 occupies an offset 105 at the outer end of a diagonal ground-engaging extension member 106 bolt-connected to the base member 10*e* of the corner frame. The offset 105 is at the left side of a socket element 106*a* on the outer end of the extension member 106. This socket element is preferably raised above the ground level such that the flat foot 87 at the rear of the bench can occupy a position beneath the socket element when the adjoining bench handle 86 occupies the offset 105.

When high pull or low pull exercises are to be performed it is preferred to have the exerciser stand on a portable platform 108 placed in front of the corner frame and presenting a round positioning element 109 fitting into the socket element 106*a*. With this platform arrangement the weight of the exerciser aids in resisting tilting of the exercise machine while exercises are being performed. In this latter regard, when the bench 15 is being used it is normally positioned on the roller 104 in the manner previously described. As a result, the weight of the exercising person occupying the bench assists in resisting tilting of the exercise machine responsive to exercising forces exerted to lift the selected amount of weight from the weight stack. The outreach position of the roller 104 provides good leverage for the exerciser's weight.

The described machine can be compactly shipped in knock-down condition in a form making assembly relatively easy, particularly as respects the reeving system. For example, the left brace member 12*a* can be supplied as a unit with the pulleys 75, 76, 77 and 78 and the cable 58, by use of a ball/keyhole slot connection the cable 57 and the hanger 75*a* for the pulley 75 as well as between the ends of the cable 58 and the cam strips at the butterfly station.

Figure 12:
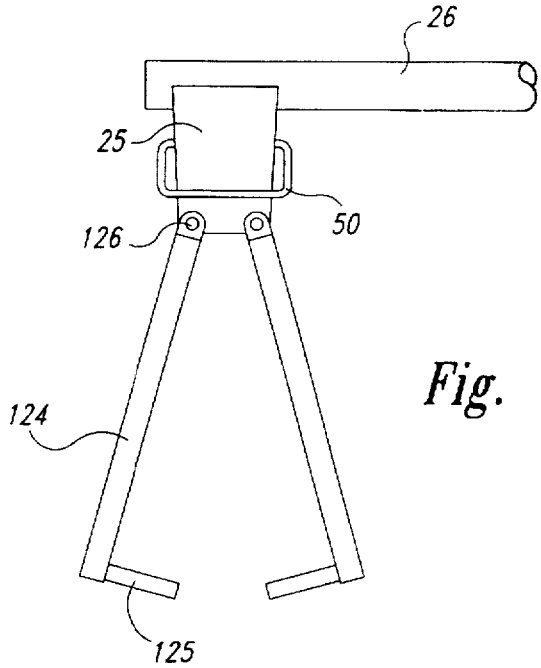
FIG. 12 is a top plan view showing an alternative press arm unit.
Figure 13:
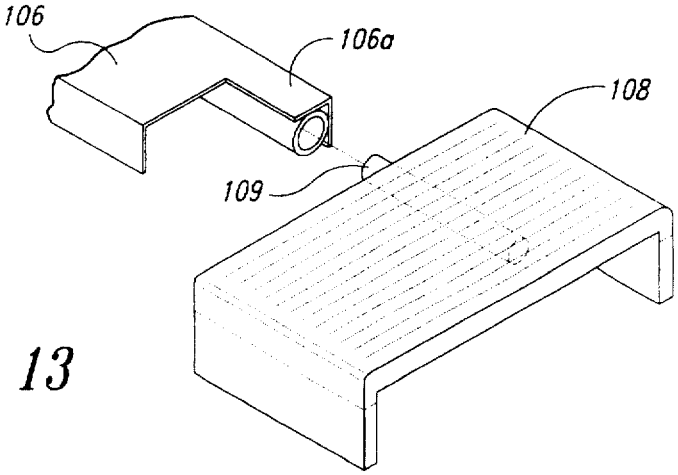
FIG. 13 is a perspective view showing the manner of connection of the portable platform.

Referring to FIG. 12, an alternative press arm arrangement is shown in which a pair of press arms 124 are pivotally mounted at a respective pivot 126 on the member 25 for left and right swinging movement. The handles 125 for the arms 124 extend toward one another. During press exercises the exercising person pushes up on the arms 124 as before, but can also move the arms out or in while pushing up on the arms. This can permit a more natural pushing motion.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A multi-station exercise machine for operating in a corner area comprising:

a frame assembly having a rear upright corner frame and frame extensions extending as first and second wings from said corner frame in respective first and second vertical wing planes which are in generally perpendicular relationship to one another at the rear of the corner area, said frame assembly having a ground engaging outrigger projecting by an outer end into said corner area;

high pull and low pull exercise stations facing said area and located at the top and bottom, respectively of said corner frame so as to be arranged to be used by an exerciser occupying said area;

a butterfly exercise station mounted at the outer end of said first wing to occupy a position entirely within said corner area, said butterfly exercise station including a seat extending into said area in generally parallel relation to said second wing plane and including two butterfly arms arranged to swing over said area about vertical swing axes within said area;

a press exercise station at the outer end of said second wing and including a press arm arranged to swing within a swing range entirely over said area about a horizontal swing axis which is perpendicular to said first wing plane;

a bench in said area partly seated on said outrigger and adjustable in position horizontally at one end relative to said outrigger;

a weight load at said corner frame;

and a pulley and cable system mounted on said frame assembly and continuously operatively connecting said exercise stations with said load whereby said load is moved responsive to performance of the respective exercises at said exercise stations.

2. An exercise machine according to claim 1 in which said bench has leg exercising apparatus at an outer end thereof to be operated in said area when the opposite end of the bench has a position adjacent said corner frame with the bench extending outwardly in said area between said wings clear of said seat, said leg exercising apparatus having an extension cable detachably connected to said pulley and cable system adjacent said low pull exercise station for connecting said apparatus with said load, said bench having an alternate position in said area in which its said opposite end is adjacent said press exercise station and the bench is in generally parallel relation to said first wing plane to be occupied by an exercising person at the press exercise station.

3. An exercise machine according to claim 2 in which said outrigger is arranged to be seated upon by said bench when the bench is in either of its positions.

4. An exercise machine according to claim 1 in which said bench is positioned in said corner area to extend from said press station in generally parallel relation to said first wing and spaced from said seat, said bench engaging said outrigger adjacent the outer end of the outrigger.

5. An exercise machine according to claim 4 in which said bench has an alternative position in said corner area to extend from said corner frame between said wings and beyond said seat, said bench having a leg exercising apparatus optionally connectable to said pulley and cable system by a cable extension at said low pull station.

6. An exercise machine according to claim 4 in which said bench has leg exercising apparatus at an outer end remote from said corner frame, said bench having an alternate position in said corner area extending from said corner frame between said wings and clear of said seat, for use of said leg exercising apparatus, and means for extending said system to said leg exercising apparatus.

7. An exercise machine according to claim 1 in which said outrigger extends at the outer end of the second wing into said area at ground level in generally parallel relation to said first wing.

8. A multi-station exercise machine comprising:

a frame assembly having a corner frame section and having first and second wing sections extending in generally perpendicular relation to one another and defining the rear of a corner exercise area;

a press exercise apparatus mounted on said first wing to operate entirely in said area;

a second exercise apparatus mounted on said second wing to operate entirely in said area;

high pull and low pull stations in said area at the top and bottom, respectively, of said corner section;

a weight load at said corner section;

and a pulley and cable system carried by said frame assembly and including:

a high pull cable extending between said high pull station and said load;

a low pull cable extending between said low pull station and a first floating pulley;

a double floating pulley unit having an upper pulley engaged by said high pull cable and a lower pulley engaged by said low pull cable;

a second exercise cable passing over said first floating pulley and extending to said second exercise apparatus;

a second floating pulley having said low pulley cable passing thereunder;

and a press cable extending downwardly from said second floating pulley under a guide pulley mounted on said corner frame section and then extending forwardly to said press exercise apparatus, said second floating pulley having a vertical travel range adjacent said corner frame section;

said press exercise apparatus including:

a press arm;

an elongated horizontal tube fixed to said press arm and mounted at an outer end on said first wing and mounted at an inner end on said corner frame section to turn about its longitudinal axis responsive to up and down swinging movement of said press arm;

a swing-mounted cam unit interconnected with said tube adjacent its said inner end and connected to said press cable such that said cam unit engages and causes tensioning of the press cable responsive to upward swinging of said press arm and responsive forward swinging of the cam unit;

and a stop element extending between said cam unit and said corner frame section for limiting swing movement of said cam unit responsive to tensioning of said press cable when said high pull station low pull station or second exercise unit are used, said stop element extending adjacent the portion of said press cable which is between said second floating pulley and said guide pulley.

9. An exercise machine according to claim 8 in which said tube is interconnected with said cam unit via an adjustment mechanism carried by said frame assembly for varying the swing range of said press arm, said adjustment mechanism including a rocker shaft extending within said tube from a position adjacent to said press arm to a position adjacent said corner frame section.

10. An exercise machine according to claim 8 in which said pulley and cable system includes a low pulley engaged by said low pull cable and mounted near the base of said corner frame section, said low pull cable having an extension;

said exercise machine also having a bench carrying an exercise device detachably connected to said extension, said bench having alternative positions in said area extending from said corner frame section or from said press exercise apparatus at said first wing.

11. A multi-station exercise machine for operating in a corner area comprising:

a frame assembly having a rear upright corner frame and frame extensions extending as first and second wings from said corner frame in generally perpendicular relationship to one another, first and second exercise apparatus at the top and bottom, respectively, of said corner frame, and arranged to be used by an exerciser occupying said area;

third and fourth exercise apparatus mounted at the outer end of said first and second wings, respectively, and arranged to be used by a exerciser occupying said area;

a weight load at said corner frame;

a pulley and cable system mounted on said frame assembly and continuously operatively connecting all four of said exercise apparatus with said load whereby said load is moved responsive to operation of each exercise apparatus;

a ground engaging outrigger on said second wing extending into said area;

a bench having a fifth exercise apparatus at an outer end thereof to be operated when an inner end of the bench is positioned at a first position adjacent said corner frame with the bench extending outwardly into said corner area approximately midway between said wings, said bench having an alternative second position in which its said inner end is adjacent said fourth exercise apparatus and the bench is in generally parallel relation to said first wing;

said bench interfitting with said outrigger at an interfit position in said area outwardly of said fourth exercise apparatus when said bench is in either of said first and second positions; and an extension cable on said fifth exercise apparatus detachably connected to said pulley and cable system adjacent said second exercise apparatus for connecting said fifth exercise apparatus with said load.

12. An exercise machine according to claim 11 in which said interfit between said bench and outrigger comprises an upstanding roller on said outrigger at said interfit position and a downwardly facing channel along part of the length of said bench.

13. An exercise machine according to claim 11 in which said bench overlies an outer end portion of said outrigger whereby the weight of an exerciser occupying such bench assists in resisting tilting of said frame assembly.

14. An exercise machine according to claim 11 in which said third and fourth exercise apparatus comprise butterfly exercise apparatus and press exercise apparatus respectively; and said butterfly exercise apparatus includes a seat in said area.

15. An exercise machine comprising:

a cornerframe section;

first and second wing frame sections connected to said corner frame section and extending in perpendicular relation to one another;

said first section having a ground engaging outrigger remote from said corner frame section;

a bench engaging said outrigger to assist in keeping the outrigger in ground engagement when the bench is occupied by an exercising person;

an extension member having a rotary axis and journal mounted at inner and outer ends, respectively, on said corner section and first wing frame section to turn on said axis;

a press arm mounted on an outer end portion of said member to swing over said bench;

a swing member mounted on an inner end portion of said member to swing responsive to swinging of said press arm;

an adjustment plate beside said swing member and mounted to swing on said rotary axis;

a latching finger extending through a slot in said swing member to selectively latch said adjustment plate when said latching finger is in a latching position at an inner end of said slot and to disengage from said adjustment plate when said latching finger is at an outer end of said slot;

an adjustment lever adjacent said press arm adapted to be swung between engaged and disengaged positions;

a linkage mechanism between said lever and said finger for selectively moving said finger in said slot relative to movement of said lever;

a load;

and a load transfer mechanism between said load and adjustment plate for moving said load responsive to operation of said press arm when said finger is in said latching position.

16. An exercise machine according to claim 15 in which said load transfer mechanism includes a cam coupled to said adjustment plate, and a pulley and cable system interconnecting said load and cam and including a cable arranged to wrap on said cam responsive to swinging movement of said adjustment plate in a direction opposed by said load.

* * * * *